US005556025A

United States Patent [19]

Sloan

[11] Patent Number: 5,556,025

[45] Date of Patent: Sep. 17, 1996

[54] GIFT WRAPPING SLEEVE

[76] Inventor: Alan B. Sloan, 5248 Breeze Hill Pl., Troy, Mich. 48098

[21] Appl. No.: 346,365

[22] Filed: Nov. 29, 1994

Related U.S. Application Data

[63] Continuation of Ser. No. 44,959, Apr. 8, 1993, abandoned.

[51] Int. Cl.[6] ..... B65D 30/10

[52] U.S. Cl. ..... 229/87.19; 383/84; 383/120

[58] Field of Search ..... 229/87.19, 87.08, 229/87.18, 938, 87.12, 87.13; 383/120, 123, 84

[56] References Cited

U.S. PATENT DOCUMENTS

| | | | |
|---|---|---|---|
| 683,790 | 10/1901 | Parmenter | 229/87.12 X |
| 1,881,890 | 10/1932 | Offenbacher . | |
| 1,999,135 | 4/1935 | Back | 229/87.12 X |
| 2,026,140 | 12/1935 | Poppe . | |
| 2,082,714 | 6/1937 | Midulla . | |
| 2,106,475 | 1/1938 | Brandwein | 229/87.12 X |
| 2,128,374 | 8/1938 | Midulla | 229/87.12 X |
| 2,324,017 | 7/1943 | Neumair | 229/87.12 X |
| 2,353,669 | 7/1944 | James | 229/87.19 |
| 2,364,297 | 12/1944 | James | 229/87.19 |
| 2,365,704 | 12/1944 | James | 229/87.19 |
| 2,433,994 | 1/1948 | James | 229/87.19 |
| 2,559,000 | 7/1951 | Back | 229/87.12 X |
| 3,035,754 | 5/1962 | Meister | 383/120 |
| 3,210,200 | 10/1965 | Billeb | 229/87.08 X |
| 3,366,313 | 1/1968 | Culberg et al. | 229/87.19 |
| 3,658,240 | 4/1972 | Stoll . | |
| 3,790,069 | 2/1974 | Staccamore . | |
| 4,186,955 | 2/1980 | Campbell . | |
| 4,608,259 | 8/1986 | Cortopassi . | |
| 4,764,030 | 8/1988 | Humphrey | 383/120 |
| 4,881,646 | 11/1989 | Weber | 229/87.08 X |
| 5,186,988 | 2/1993 | Dixon | 229/87.19 X |
| 5,215,249 | 6/1993 | Gorrieri | 229/87.08 X |

FOREIGN PATENT DOCUMENTS

| | | | |
|---|---|---|---|
| 3600501 | 5/1987 | Germany | 383/123 |

*Primary Examiner*—Jes F. Pascua

*Attorney, Agent, or Firm*—Harness, Dickey & Pierce P.L.C.

[57] ABSTRACT

A gift wrapper which significantly simplifies the practice of gift wrapping while still producing an aesthetically pleasing gift-wrapped article. In particular, a preformed gift wrapping sleeve for use in gift wrapping a hexahedronally-shaped article of a predetermined size, whereby the steps necessary to gift wrap the article are simplified and minimized. The gift wrapping sleeve is a single piece of sheet material having a decorative design incorporated on its exterior surface suitable for any occasion. The sheet material is folded to form two pairs of opposite side wails. The first pair of side walls extend at different lengths such that there is a longer wall and a shorter wall and the second pair of side walls have creases that extend their entire lengths. One end of the sleeve is pre-closed. The article to be gift wrapped is placed within the sleeve and the other end of the sleeve is closed and secured by adhesion means located near the end of the longer wall.

1 Claim, 2 Drawing Sheets

GIFT WRAPPING SLEEVE

This is a continuation of U.S. patent application Ser. No. 08/044,959, filed Apr. 8, 1993, now abandoned.

BACKGROUND AND SUMMARY OF THE INVENTION

1. Technical Field

The present invention relates generally to wrapping materials and, more particularly, to a decorative sleeve for gift wrapping hexahedronally-shaped articles and the like.

2. Discussion

Presently, there are a variety of ways in which boxes and other articles can be decoratively gift wrapped. However, most are generally laborious, inconvenient, time consuming and require at least some degree of artistic skill or craftsmanship to produce a functional and aesthetically pleasing finished gift wrapped article.

A common gift wrapping procedure typically consists of first measuring and cutting a desired amount of wrapping paper from a supply roll or other source and then forming and securing the paper about the article to be wrapped. To achieve the latter, it is often necessary to fold and crease the wrapping paper a number of times so that the excess or overlapping wrapping paper is conformed to the shape of the article being wrapped. Further, adhesive tape, string, ribbon, or the like must then be utilized to maintain the folded wrapping paper in its desired configuration.

An alternative method of gift wrapping frequently employed involves placing the article to be wrapped in a decorative, open-ended bag that may be garnished with tissue paper, ribbon, or the like. However, these bags can not be closed around the article and, thus, the aesthetic effect of conventional gift wrapping is not achieved. Also, often the articles placed in the bag are separately gift wrapped themselves and, therefore, the inconvenience and other burdens of conventional girl wrapping still remain.

It is therefore a primary object of the present invention to significantly simplify the practice of gift wrapping while still producing aesthetically pleasing gift-wrapped articles.

It is another object of the present invention to enable aesthetically pleasing gift wrapped articles to be achieved by those lacking any artistic skill, talent or craftsmanship, whatsoever.

In particular, it is an object of the present invention to provide a preformed gift wrapping sleeve for use in gift wrapping a hexahedronally-shaped article of a predetermined size, whereby the steps necessary to gift wrap the article are simplified and minimized.

The gift wrapping sleeve of the present invention includes a single, continuous piece of non-self-supporting sheet material having a decorative design incorporated on its exterior surface which may be suitable for any occasion. The sheet material is folded to form two pairs of opposite side walls. The first pair of side walls extend at different lengths such that there is a longer wall and a shorter wall. The second pair of side walls have creases that extend their entire lengths which enable the gift wrapping sleeve to be collapsible to a storage position when not in use. One end of the sleeve is pre-closed by folding the second pair of side walls along their creases and then folding and securing the longer wall to the shorter wall. The article to be gift wrapped is then placed within the sleeve and the other end of the sleeve is closed in the same manner as the first, with the longer wall being secured to the shorter wall by adhesion means located near the end of the longer wall.

BRIEF DESCRIPTION OF THE DRAWINGS

The various advantages of the present invention will become apparent to one skilled in the art upon reading the following specification, in which:

FIG. 3 shows the operation of wrapping an article with the gift wrapping sleeve of FIG. 1.

DESCRIPTION OF THE PREFERRED EMBODIMENT

Figure 1:
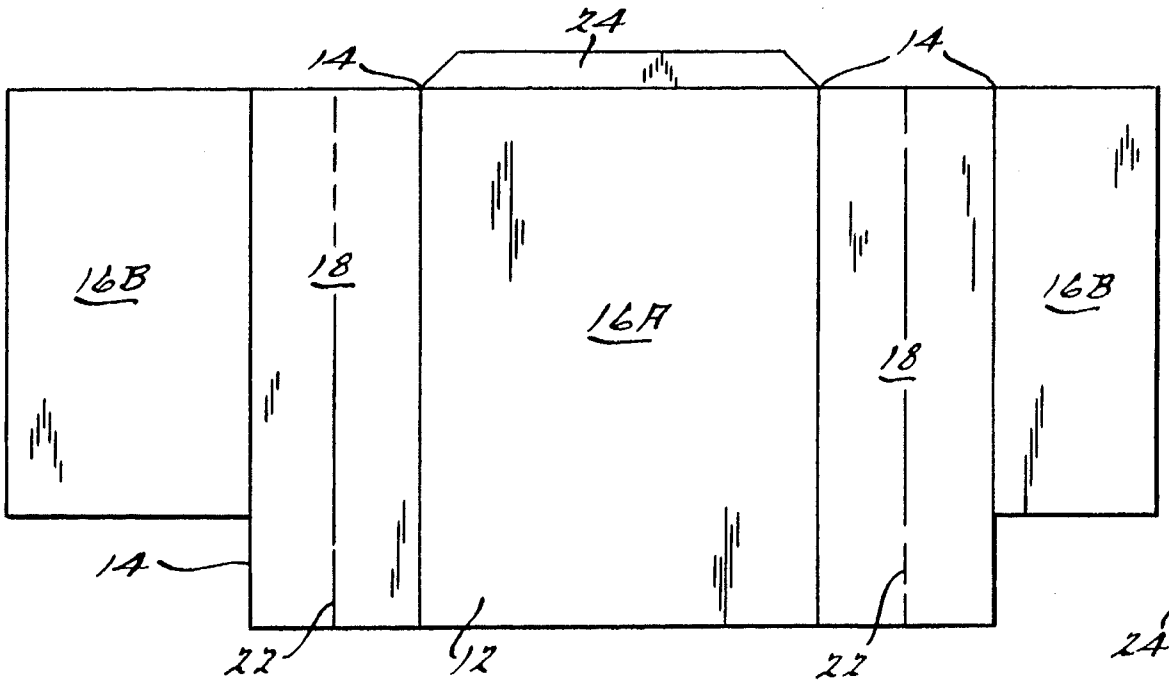
FIG. 1 shows a development view of the gift wrapping sleeve of the present invention.

Referring now to the drawings, the gift wrapping sleeve 10 of the present invention is illustrated in the development view of FIG. 1. Gift wrapping sleeve 12 is produced of a non-transparent self-supporting sheet material is preferably constructed from a single, continuous piece of sheet material 12 which includes a decorative or festive pattern such as shown for illustrative purposes in FIG. 4. Typically, the sheet material 12 can be a thin paper or the like, and can be generally non-self-supporting.

Figure 2:
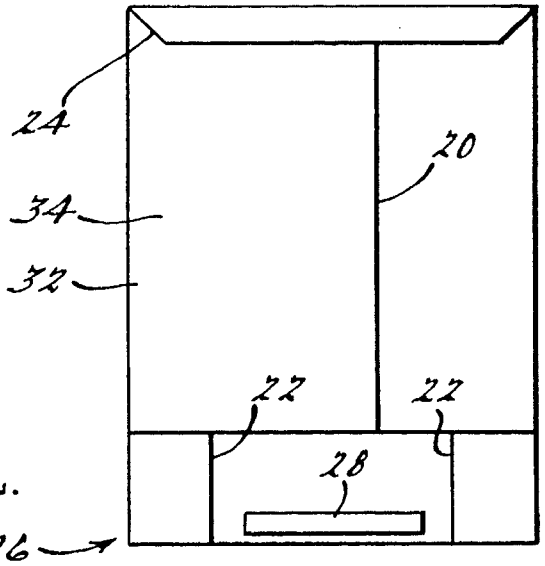
FIG. 2 shows the gift wrapping sleeve of FIG. 1 in a collapsed configuration.

In a preferred embodiment, to make the gift wrapping sleeve 10, the sheet material 12 is first folded along fold lines 14 in a manner such that there is formed first and second pairs of opposite side walls 16, 18. Each side wall in the first pair 16 extends at a different length as is illustrated in FIGS. 1 and 2, such that there is a longer wall 16A and a shorter wall 16B. A seam 20 runs the length of the shorter wall 16B to close the sleeve 10. The second pair of side walls 18 are formed to include creases 22 which extend the entire length of each second wall 18, and which enable the present invention to be collapsible to a stored position when not in use, as best illustrated in FIG. 2.

As also shown in FIG. 2, the sleeve 10 is closed at a first end portion 24 of the side walls 16, 18. The second pair of side walls 18 is folded along their respective creases 20 and the longer wall 16A is folded toward, and secured to, the shorter wall 16B so that it is fixed in a position overlapping the shorter wall 16B. At a second end portion 26, adhesion means 28 are located on the longer wall 16A. The adhesion means 28 can be a glue, tape, or the like and can be covered by a non-adhesive intermediate strip 30 to prevent any premature or unwanted adhesion as shown in FIG. 2. However, the adhesion means 26 can also be of the type that requires to be moistened before adhesion takes place. As illustrated in FIG. 2, the gift wrapping sleeve 10 is now in a preformed configuration and is prepared to receive an article to be gift wrapped.

As illustrated, the sheet material 12 is of a composition which will cover the box to be gift wrapped such that it will not be visible through the sheet material. Sheet material 12 is preferably a gift wrap which includes a decorative design, pattern or indicia 32, which may be printed, embossed or otherwise incorporated on the exterior surface 34 of the sheet material 12. The decorative design 32 can vary to be suitable for any occasion in which the gift wrapping of an article is desirable, such as a birthday, a wedding, Christmas or other holidays, or the like.

Referring now to FIG. 3, a hexahedronally-shaped (i.e. box-like) article 36 is shown ready to be gift wrapped. The article 36 has a predetermined size L, W, H (i.e. length, width and height) which corresponds to the dimensions of the gift wrapping sleeve 10 so that the sleeve 10 fits snugly about the width W and height H of the article 36, yet loosely extends about the article's length L. It should be noted that it is well-known in the art that gift boxes or the like are manufactured in a variety of standard sizes for items such as clothing, jewelry, toiletries and other articles and are readily available. For this reason it is intended that the gift wrapping sleeve 10 of the present invention be constructed in the same variety of sizes in order to accommodate the different standard sized boxes. Consequently, one desiring to make use of the present invention to gift wrap an article need not have an article that conforms to the desired predetermined dimensions as described above, but may simply utilize a standard sized box to facilitate the gift wrapping procedure.

In this regard where such standard sizes are available the present invention would be utilized to accommodate these sizes. Alternatively, the present invention could be utilized and sold in combination with the corresponding box size. This would allow a purchaser to purchase a suitable box size for a gift and have the gift sleeve ready for wrapping.

The present invention greatly simplifies the gift wrapping procedure as will now be described. Referring once again to FIG. 3, the article 36 to be gift wrapped is placed within the open second end portion 26 of the gift wrapping sleeve 10 as is indicated by arrow A. The gift wrapping process is then completed by closing and securing the open end portion 26. This is accomplished simply by first folding the second pair of side walls 18 along their respective creases 22 as indicated by arrows B and then folding the longer wall 16A over the top of the shorter wall 16B and utilizing adhesion means 28 to maintain the closed configuration as indicated.

Figures 2, 4:
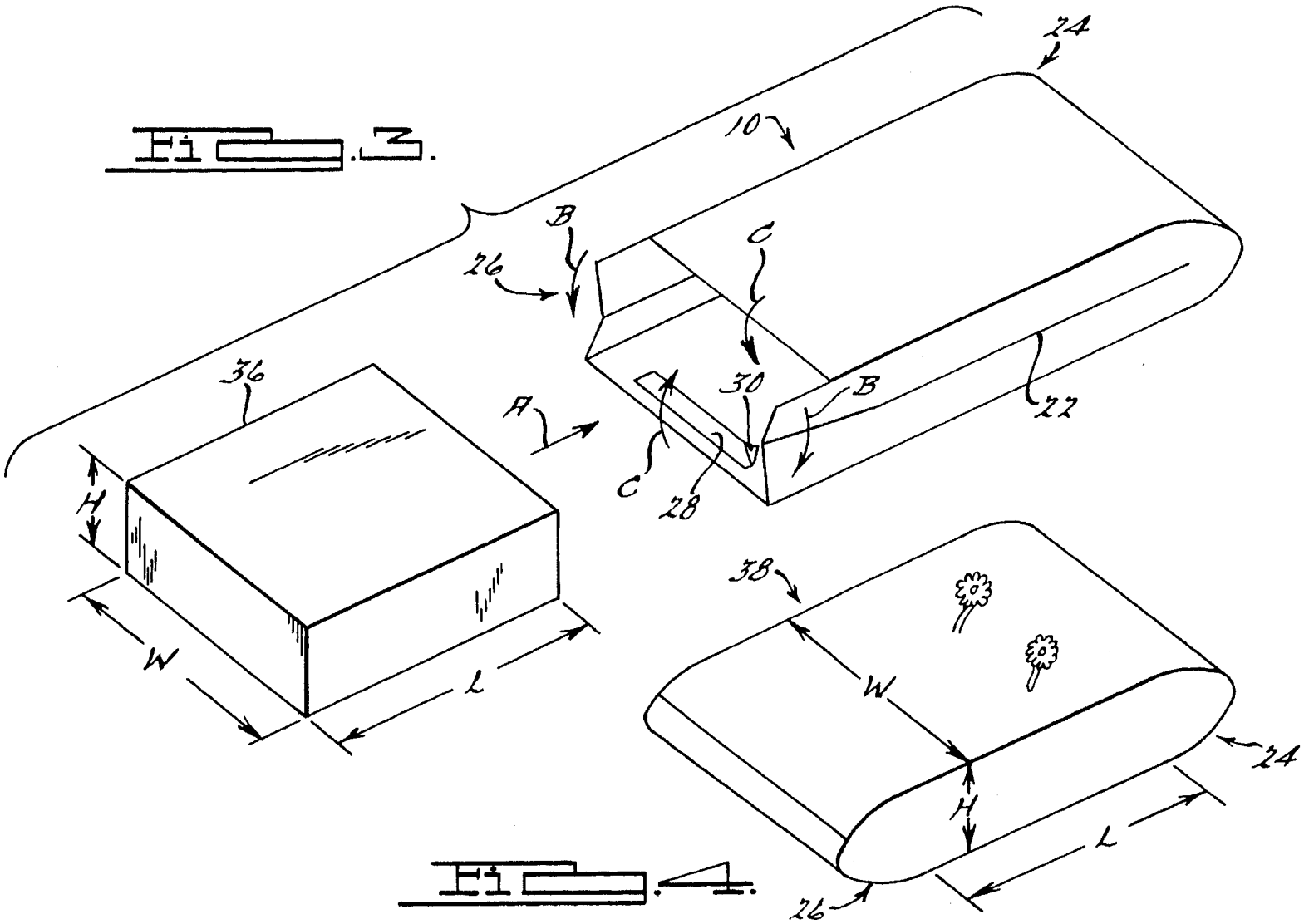
FIG. 4 shows the article finish gift wrapped with the gift wrapping sleeve of FIG. 1.

Illustrated in FIG. 4 is a finished gift wrapped article 38 utilizing the present invention. Note that end portions 24 and 26 of the gift wrapping sleeve 10 extend beyond the longitudinal (i.e. length) dimension L of the article 36, but that the opposing pairs of side walls 16 and 18 snugly conform to the article's height H and width W. It can be appreciated that the gift wrapped article 38 may be further garnished with bows, ribbon, or the like (not shown).

Thus, what has been described is a gift wrapping sleeve 10 which greatly simplifies the gift wrapping hexahedronally-shaped (i.e. box-like) articles 36 and a method of gift wrapping utilizing the gift wrapping sleeve 10. Various other advantages and modifications will become apparent to one skilled in the art after having the benefit of studying the teachings of the specification, the drawings, and the following claims. Thus, while the above description constitutes the preferred embodiment of the present invention, it is to be appreciated that the invention is susceptible to modification, variation and change without departing from the proper scope and fair meaning of the accompanying claims.

What I claim is:

1. A gift wrapping sleeve in combination with a hexahedronally-shaped article, a said hexahedronally-shaped box having a predetermined length, width and height, comprising:

a non-self-supporting sheet material, said sheet material having a decorative exterior surface and being configured to form a first pair of opposite side walls and a second pair of opposite side walls, said first and second pairs of opposite side walls each having a first end portion, a second end portion and an intermediate portion therebetween, said first end portions being closed at the terminal ends thereof to provide a stop when the hexahedronally-shaped box is placed into said sheet material, and said second end portion of said first pair of opposite side walls defining an opening and having means for closing said second end of each of said pairs of opposite side walls, an adhesion means is provided at said second end for securing said walls together to close said opening, said adhesive means is adhesive tape; and wherein each said pairs of opposite side walls are dimensioned to extend beyond the predetermined length of the hexahedronally-shaped box, and said intermediate portion is dimensioned to conform to the width and height of the hexahedronally-shaped article, one wall of said first pair of opposite sides is longer than the other wall at said second end whereby said longer wall can be folded;

said sleeve is to be manually wrapped securely about the width and height of the hexahedronally-shaped box, and said first and second ends of said pairs of opposite side walls extend beyond the length of the hexahedronally-shaped box on either side thereof and said second ends converge toward one another and are attached together upon wrapping of the article such that said closed ends form an angle to one another to provide an overall arcuate appearance when viewed in side elevation when expanded to hold the hexahedronally-shaped box.

* * * * *